US007168780B2

(12) United States Patent
Mochizuki

(10) Patent No.: US 7,168,780 B2
(45) Date of Patent: Jan. 30, 2007

(54) METHOD OF INSPECTING AN INKJET HEAD AND THE INSPECTED INKJET HEAD

(75) Inventor: Yoshiaki Mochizuki, Fuji (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 269 days.

(21) Appl. No.: 10/770,620

(22) Filed: Feb. 2, 2004

(65) Prior Publication Data

US 2005/0168512 A1 Aug. 4, 2005

(51) Int. Cl.
*B41J 29/393* (2006.01)
*B41J 29/38* (2006.01)

(52) U.S. Cl. ..... 347/19; 347/10

(58) Field of Classification Search ..... 347/19, 347/10

See application file for complete search history.

(56) References Cited

U.S. PATENT DOCUMENTS 6,116,713 A * 9/2000 Maru ..... 347/17
6,224,182 B1 * 5/2001 Nagoshi et al. ..... 347/19
6,398,331 B1 * 6/2002 Asaka et al. ..... 347/9
6,485,133 B1 11/2002 Teramae et al.
2001/0007457 A1 * 7/2001 Nagoshi et al. ..... 347/19
2001/0055042 A1 * 12/2001 Matsumoto et al. ..... 347/19
2002/0036669 A1 * 3/2002 Hosono et al. ..... 347/19
2002/0167558 A1 * 11/2002 Kojima ..... 347/9
2003/0189609 A1 * 10/2003 Ishikawa ..... 347/11
2004/0080596 A1 * 4/2004 Taguchi et al. ..... 347/100
2004/0189732 A1 * 9/2004 Usuda ..... 347/19

FOREIGN PATENT DOCUMENTS

JP 10-016226 A 1/1998
JP 10-193610 A 7/1998
JP 2000-318153 A 11/2000

* cited by examiner

*Primary Examiner*—Stephen Meier
*Assistant Examiner*—Rene Garcia, Jr.
(74) *Attorney, Agent, or Firm*—Frishauf, Holtz, Goodman & Chick, P.C.

(57) ABSTRACT

A driving waveform which an inkjet head filled with inspecting ink shows is measured. The measured driving waveform is corrected based on a correlation formula, which is obtained beforehand based on image recording ink the inkjet head uses for image recording. The inkjet head is set to have a driving waveform based on a result of correction.

9 Claims, 4 Drawing Sheets

| Measurement when master ink is used | a~b | b~c | c~d | d~e | e~f |
|---|---|---|---|---|---|
| Rank | 1 | 2 | 3 | 4 | 5 |

| Measurement when oil ink is used | a~b | b~c | c~d | d~e | e~f |
|---|---|---|---|---|---|
| Rank | 1 | 2 | 3 | 4 | 5 |

| Measurement when ultraviolet ink is used | a~b | b~c | c~d | d~e | e~f |
|---|---|---|---|---|---|
| Rank | 1 | 2 | 3 | 4 | 5 |

METHOD OF INSPECTING AN INKJET HEAD AND THE INSPECTED INKJET HEAD

BACKGROUND OF THE INVENTION

1. Field of the Invention

The present invention relates to a method of inspecting an inkjet head and the inspected inkjet head.

2. Description of the Related Art

It is generally known that in the process of manufacturing inkjet heads, the head characteristics, such as driving waveforms and driving voltages, tend to vary due to the differences in the lots of piezo-electric members, the manufacturing variations, etc. Therefore, not only the inkjet heads of one head manufacturing lot have different driving waveforms and different driving voltages from those of the inkjet heads of another head manufacturing lot, but also each individual inkjet head may have different characteristics from those of another inkjet head. In many cases, there is only one setting rank in regard to the driving waveforms of inkjet heads. If an inkjet head has a driving waveform that does not fall within this predetermined setting rank, it cannot be shipped as a commercial product. If piezoelectric members of one lot have characteristics that do not fall within a predetermined setting rank, they can be merely used as top plates, and the manufacturing efficiency therefore deteriorates. As a result, the inkjet heads are inevitably costly.

In a method of measuring the driving waveform and driving voltage of an inkjet head, it is known to fill colorless ink, oil ink, ultraviolet ink or the like into the inkjet head. Since the colorless ink does not contain dyes or pigments, it can provide improved preservation, stability and cleaning characteristics. It is for this reason that some manufacturers use the colorless ink. In many cases, the inkjet heads are not merely tested as to their driving waveforms and driving voltages; they are tested as to their printing characteristics as well because whether the ink is jetted properly and whether the direction in which the ink is jetted are evaluated by actually jetting the ink. In order to accurately evaluate the printing characteristics of the inkjet heads, the evaluation should be based on actually printed samples, but the colorless ink does not enable this evaluation. On the other hand, the ultraviolet ink and the oil ink enable measurement of the driving waveform and the driving voltage, and enable printing tests as well because they can be printed on sheets of paper in a recognizable way. Despite this, however, the ultraviolet ink and the oil ink are undesirable in that they cannot be easily cleaned after the inspection. If the interior of an inkjet head is not perfectly cleaned, the ultraviolet ink or the oil ink may be left as stains inside an ink supply tube. Moreover, different users, who use the inkjet heads, use different kinds of ink for recording images. If the printing test requires the same kinds of ink as the users use, the efficiency of the test may be very poor.

Under the circumstances, there is a need for an inkjet head inspection method that enables the driving waveform and the driving voltage to be properly determined with high efficiency during the inspection at the time of shipment.

BRIEF SUMMARY OF THE INVENTION

According to one aspect of the present invention, an inkjet head inspection method measures a driving waveform of an inkjet head filled with inspection ink, corrects the measured driving waveform-based on a correlation formula which defines correlations between driving waveforms and the kinds of image recording ink the inkjet heads use for recording images, and sets the inkjet head to have a driving waveform based on the results of correction.

Objects and advantages of the invention will become apparent from the description, or may be learned by practice of the invention.

BRIEF DESCRIPTION OF THE SEVERAL VIEWS OF THE DRAWING

The accompanying drawings illustrate embodiments of the invention, and together with the general description given above and the detailed description given below, serve to explain the principles of the invention.

DETAILED DESCRIPTION OF THE INVENTION

An embodiment of the present invention will now be described with reference to the accompanying drawings.

Figure 1:
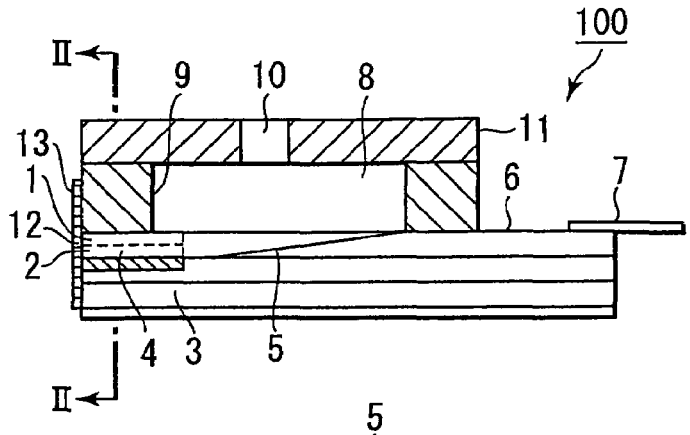
FIG. 1 is a sectional view showing an inkjet head according to one embodiment of the present invention.
Figure 2:
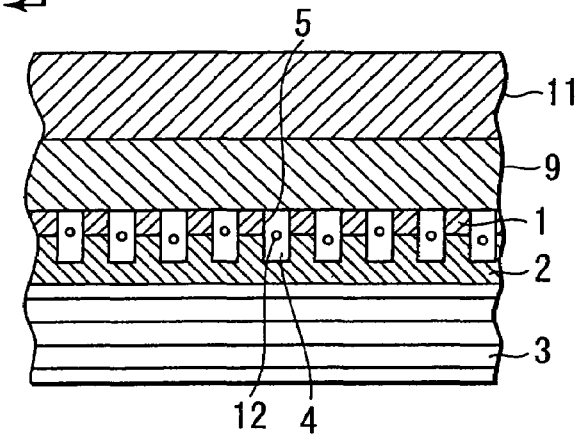
FIG. 2 shows part of the section taken along line II—II of FIG. 1.

The structure of an inkjet head 100 will be described first, referring to FIGS. 1 and 2. FIG. 1 shows a section of the inkjet head 100, and FIG. 2 shows part of the section taken along line II—II of FIG. 1. As shown in FIGS. 1 and 2, the inkjet head 100 uses piezoelectric members as an actuator. To be more specific, two rectangular piezoelectric members 1 and 2 are stacked one upon the other in such a manner that their polarization directions are opposite in the thickness direction of the plates. The resultant structure is fixed to a substrate 3 having a smaller dielectric constant than that of the piezoelectric members. The piezoelectric members 1 and 2 are then subject to a cutting process that uses a diamond cutter, for example. By this cutting process, a plurality of long grooves having the same width, the same depth and the same length are formed in parallel at the constant intervals, thereby forming ink chambers 4.

An electrode 5 is formed on the side and bottom surfaces of each ink chamber 4 by electroless nickel plating. In addition, an electrode 6 is formed by electroless nickel plating in such a manner that the electrode 6 extends from the rear end of each ink chamber 4 to the upper surface of the rear portion of the substrate 3. A circuit board 7 is fixed to the upper surface of the rear end of the substrate 3.

A frame member 9 is fixed to the piezoelectric members 1 and 2 such that a common ink chamber 8 is defined above the ink chambers 4 of the piezoelectric members 1 and 2. The frame member 9 is covered with a top plate 11, and this top plate 11 has an ink supply port 10 communicating with the common ink chamber 8. An orifice plate 13 having a plurality of ink discharge ports 12 is fixed to the front ends of the piezo-electric members 1 and 2 by use of an adhesive.

Figure 3:
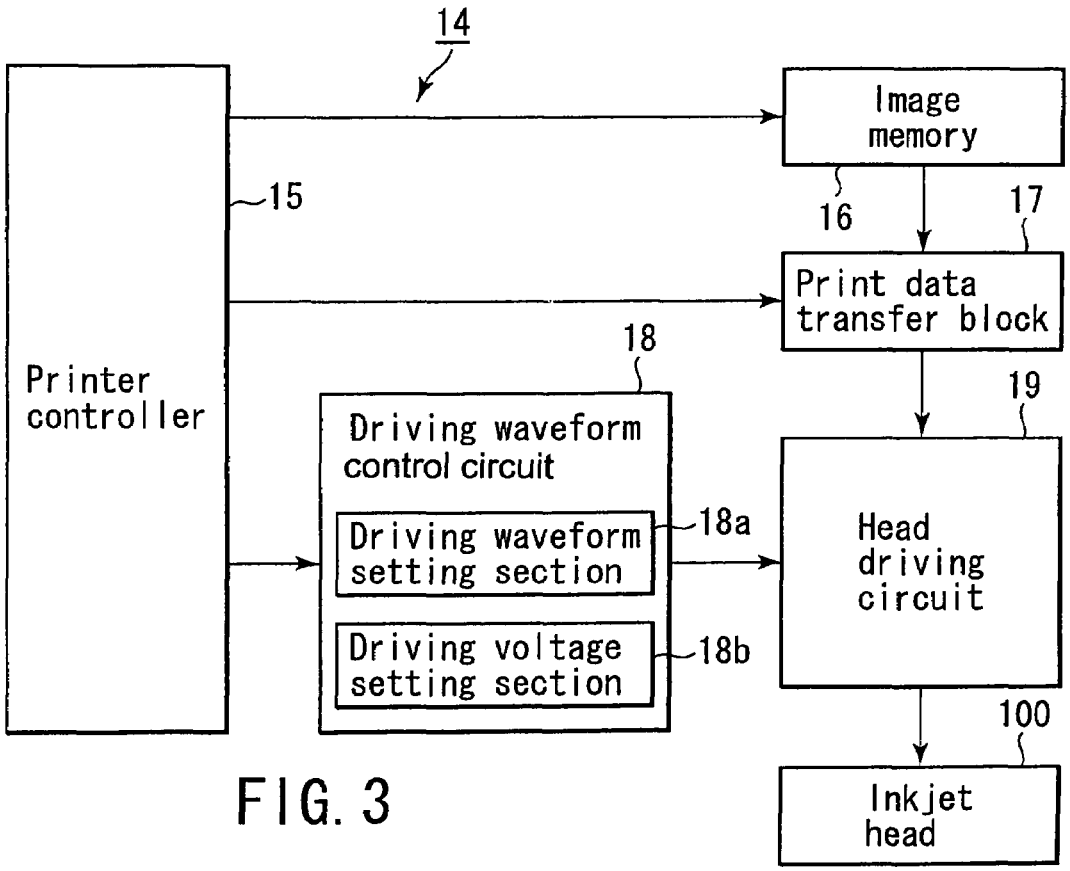
FIG. 3 is a diagram illustrating a control configuration used for driving an inkjet head.

FIG. 3 is a block diagram showing the major portion of a driving controller 14 that drives the inkjet head 100 of the above structure. The major portion of the driving controller 14 includes a printer controller 15, an image memory 16, a print data transfer block 17, a driving waveform control circuit 18 and a head driving circuit 19. The printer controller 15 records print data in the image memory 16, and then transfers the print data from the image memory 16 to the head driving circuit 19 by way of the print data transfer block 17. The driving waveform control circuit 18 includes: a driving waveform setting section 18*a* for setting a driving waveform used for driving the head driving circuit 19; and a driving voltage setting section 18*b* for setting a driving voltage used for driving the head driving circuit 19. Controlled by the printer controller 15 and the driving waveform control circuit 18, the head driving circuit 19 drives the inkjet head 100. The driving waveform control circuit 18 and the head driving circuit 19 are provided on the circuit board 7 described above.

With respect to the inkjet head 100, an optimal driving waveform is measured (the measurement will be described later) and the discharge performance is inspected using the optimal driving waveform. There-after, the inkjet head 100 is installed in an inkjet recording apparatus (not shown) owned by an end user. When the inkjet head 100 is installed in the inkjet recording apparatus, the circuit board 7 is connected to the control section of the inkjet recording apparatus by means of a bus line, for example. Therefore, the user can operate a control panel to display the driving waveform information set with respect to the driving waveform setting section 18*a* of the circuit board 7. In other words, the inkjet head 100 can inform the control panel of the driving waveform in an early stage, and when the inkjet head 100 is replaced with a new one, the new inkjet head can take over the driving waveform of the old inkjet head. This holds true not only for the driving waveform but also for the driving voltage set by the driving voltage setting section 18*b*. The driving waveform setting section 18*a* and the driving voltage setting section 18*b* store the waveform and voltage corresponding to the master ink, respectively, and the user can obtain a required ink driving waveform and ink driving voltage by using a driving waveform correlation formula and a driving voltage correlation formula. These formulas are stored in the control panel of the inkjet recording apparatus of the user and have linear (first-degree) characteristics.

With the above configuration, when the head driving circuit 19 generates a driving signal and applies it to the piezoelectric members 1 and 2, these piezoelectric members are actuated in such a manner as to change the volume of each ink chamber 4. As a result, a pressure wave is generated in the ink chamber 4, and an ink droplet is discharged from the ink discharge port 12.

Figure 4:
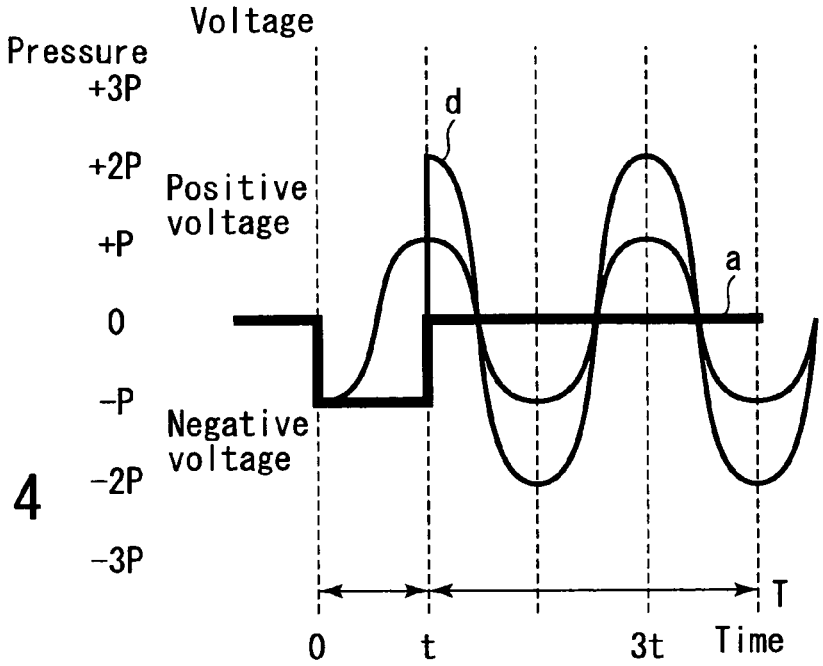
FIG. 4 is an image illustrating the case where the superimposition of pressure waves is appropriate.
Figure 5:
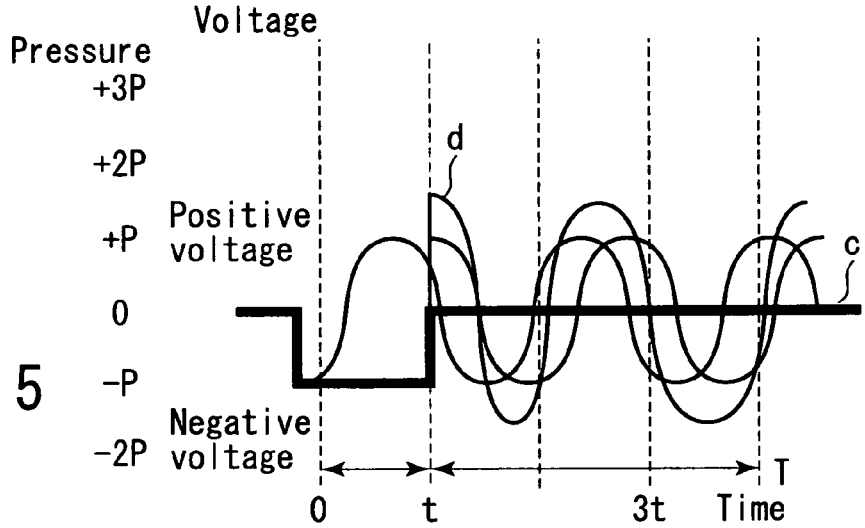
FIG. 5 is an image illustrating the case where the superimposition of pressure waves is inappropriate.

A description will now be given with reference to FIGS. 4 and 5 as to how to determine a driving waveform the inkjet head should have. As described above, the inkjet head 100 is configured to apply pressure to the ink filling the ink chambers 4 and permit ink droplets to be jetted from the ink discharge ports 12. The driving waveform is determined by measuring the conditions under which the superimposition of pressure waves becomes most efficient. Efficient superimposition of pressure waves is intended to indicate the state where liquid droplets can be discharged by application of a low driving voltage, where there is little residual vibration, and where printed images are satisfactory in quality. In general, there are various types of driving voltage depending upon specifications of inkjet heads 100, different manufacturers, different methods used for discharging ink, etc. In the present embodiment, the "1–3 waveform" will be described as an example of a driving waveform. The "1–3 waveform" is a waveform that keeps a negative pressure in the ink chambers 4 for time it (t: a current supply time) and then keeps the zero pressure for time 2*t*. In FIGS. 4 and 5, the abscissa represents time T, and the ordinate represents voltages for driving waveforms a and c and pressures for pressure waveforms b and d. FIG. 4 shows an image corresponding to the case where the superimposition of pressure waves is appropriate by application of the "1–3 waveform", and FIG. 5 shows an image corresponding to the case where the superimposition of pressure waves is inappropriate. In FIGS. 4 and 5, the pressure in the ink chambers 4 becomes highest and causes the ink to be discharged from the ink discharge ports 12, when the current supply time is it. Unlike the case shown in FIG. 4, the case shown in FIG. 5 is a case where the current supply time t is not appropriate, and the pressure waves are insufficient when the ink must be discharged. In this case, therefore, it is necessary to set the driving voltage at a high value.

Figure 6:
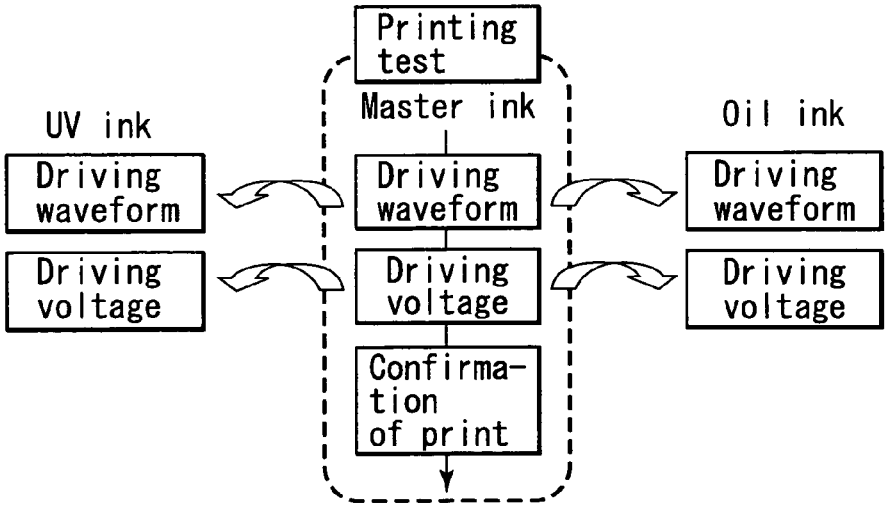
FIG. 6 is a diagram illustrating one method for setting the driving waveform and the driving voltage of an inkjet head.

A description will be given with reference to FIG. 6 as to how a driving waveform and a driving voltage are determined for the inkjet head 100, how a printing test is executed using the driving waveform and the driving voltage, and how the driving waveform and the driving voltage of the inkjet head 100 are subsequently corrected. The driving waveform and driving voltage of the inkjet head 100 are measured by use of an inspection device. Since the inspection device is a conventional type, a description of it will be omitted herein.

First of all, the operator supplies master ink (i.e., the ink used for inspection) to the inkjet head 100 by way of the ink supply port 10. As a result, the inkjet head 100 is filled with the master ink. The master ink is color dyeing ink whose dyeing concentration is adjusted to be less than the solubility. The master ink contains 70 wt. % of hydrocarbon-based oil, approximately 29 wt. % of aliphatic alcohol, and 1 wt. % or less of dyeing agent (the former two are used as a solvent). It should be noted here that "wt. %" is a unit used for indicating the weight percentage of each ingredient of the master ink. The master ink need not be limited to this composition and may be prepared by using a solvent selected from a variety of kinds and adding a dyeing agent to the solvent such that the concentration of the dyeing agent is adjusted to be less than the solubility.

Figures 7, 8, 9, 10:
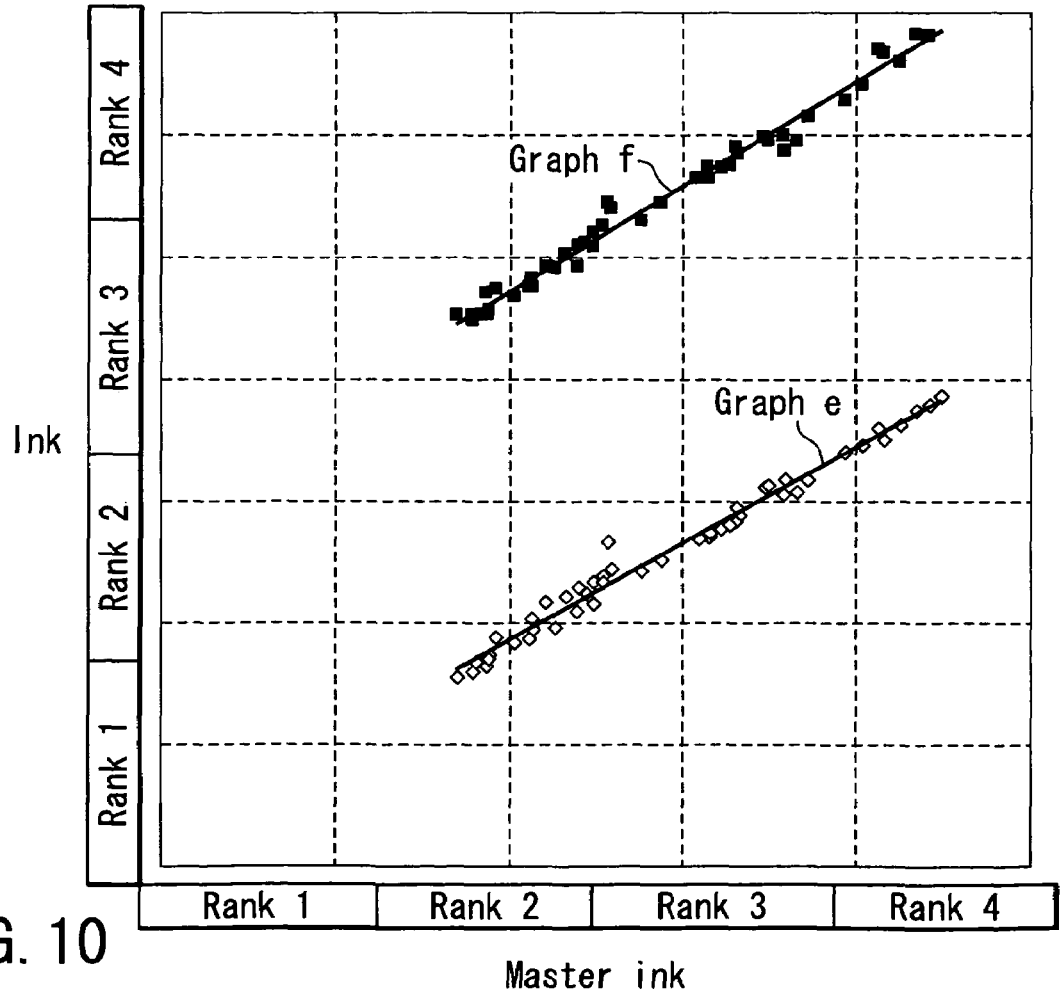
FIG. 7 is a table showing a plurality of ranks corresponding to driving waveforms which the inkjet head can have when it is filled with master ink.
FIG. 8 is a table showing a plurality of ranks corresponding to driving waveforms which the inkjet head can have when it is filled with oil ink.
FIG. 9 is a table showing a plurality of ranks corresponding to driving waveforms which the inkjet head can have when it is filled with ultraviolet ink.
FIG. 10 is a graph showing correlations of driving waveforms.

Then, the operator measures an optimal current supply time t for ink droplets to be discharged. The measurement is performed in the state where the inkjet head 100 is filled with master ink. The measurement of a driving waveform is applied to one of the five ranks shown in FIG. 7. FIG. 7 is a table showing a plurality of ranks corresponding to measurement value of driving waveforms which the inkjet head can have when it is filled with master ink. The five ranks are based on the five ranks determined with respect to the minimum resolution of heads. Predetermined different driving waveforms are set to correspond to "rank 1" to "rank 5." One of these ranks is selected for the driving waveform setting section 18*a*, and the head driving circuit 19 is operated based on the driving waveform corresponding to the rank that has been determined. In this manner, minimum resolutions are classified into ranks, and even if the measurement of the driving waveform is 2.44 vis, it is regarded as 2.5 μs after the classification to ranks. In other words, any driving waveform measurement belongs to one of the ranks. Therefore, none of the inkjet heads 100 are treated as being defective.

Next, the operator measures the driving voltage of the inkjet head 100 in the state where the inkjet head 100 is filled with master ink. The driving voltage is a voltage required for producing a predetermined discharging volume, and its value varies depending upon each inkjet head 100.

A printing test of the inkjet head 100 can be performed simultaneously with the determination of the rank assigned after measurement of the driving voltage and the setting of the driving voltage. By performing the printing test, the operator checks whether the ink is jetted properly and/or is jetted in the right direction as required. The operator also judges whether recorded image includes undesirable portions, such as an irregular density portion. Based on this confirmation, it is determined whether the inkjet heads can be shipped or not. The inspection methods include inspection based on the visual observation by human beings and inspection using a dot analyzer or another inspection device. The inspection based on the visual observation is performed by comparing tested products with a sample, and is therefore subjective. Although the results of the inspection may vary depending upon individuals who inspect the products, the inspection based on the visual observation is advantageous when it is used for rough screening. The inspection using the dot analyzer is accurate because it relies on the values to which dot diameters and dot pitches are converted. It is therefore desirable to use the above two inspection methods in combination.

As described above, since the inkjet head 100 is filled with master ink containing a dyeing agent, the printing test can be performed simultaneously when the driving waveform and the driving voltage are set with respect to the inkjet head. Where ink containing pigments is used, the inkjet head 100 may not be completely cleaned after the printing test. However, since the present invention uses ink containing a dyeing agent, the inkjet head 100 can be easily cleaned. Therefore, using the master ink when the driving waveform and the driving voltage of the inkjet head 100 are determined is very advantageous in practice. In other words, the inspection is very efficient and accurate by measuring the driving waveform by use of the master ink, subsequently determining a rank, then setting a driving voltage, and successively performing the printing test.

A description will then be given with reference to FIGS. 8–11 as to how the user of the inkjet head 100 corrects the driving waveform and driving voltage in accordance with the type of ink to be used. When the inkjet head 100 is used for image recording, the user determines which type of ink should be used, and corrects the driving waveform and voltage in accordance with the type of ink actually used. In the present embodiment, it is assumed that the ink the user intends to use for image recording is oil ink or ultraviolet ink.

When the oil ink and the ultraviolet ink are used, the measurements of the driving waveform can be correlated with one of the five ranks of minimum resolutions, as in the case where the master ink is used. FIG. 8 is a table showing how a plurality of ranks correspond to measurements of the driving waveforms obtained when the inkjet head 100 is filled with the oil ink. Likewise, FIG. 9 is a table showing how a plurality of ranks correspond to measurements of the driving waveforms obtained when the inkjet head 100 is filled with the ultraviolet ink.

With respect to the inkjet head 100 that has passed the printing test, the driving waveforms of the ink used by the user are calculated using correlation formulas. The correlation formulas for obtaining the driving waveforms are: $Ow=\alpha 1\times Mw+\beta 1$ . . . (1) (Ow is a driving waveform when oil ink is used, Mw is a driving waveform when master ink is used, and $\alpha 1$ and $\beta 1$ are constants); and $Uw=\alpha 2\times Mw+\beta 2$ . . . (2) (Uw is a driving waveform when ultraviolet ink is used, Mw is a driving waveform when master ink is used, and $\alpha 2$ and $\beta 2$ are constants). As can be seen from FIG. 10, these formulas (1) and (2) are obtained beforehand on the basis of graph e showing the driving waveform correlations between the master ink and the oil ink and graph f showing the driving waveform correlations between the master ink and the ultraviolet ink. In FIG. 10, the abscissa indicates the ranks corresponding to the case where the oil ink is used (that is, it indicates measurements of the driving waveform), and the ordinate represents the ranks corresponding to the case where the oil ink and the ultraviolet ink are used (that is, it indicates measurements of driving voltages). In FIG. 10, the correlations corresponding to "rank 1" to "rank 4" are illustrated. Since the correlations corresponding to "rank 5" are linear and similar to those shown in FIG. 10, illustration of them is omitted.

By way of example, let us assume that the ink the user uses is oil ink. In this case, the measurement of the driving waveform obtained when the master ink is used is substituted into formula (1), for correction. After this correction, the measurement is applied to the table shown in FIG. 8. As a result, current supply time t corresponding to the ink the user intends to use is calculated, and one of the five ranks of the minimum resolution is selected. The selected rank is applied to the driving waveform setting section 18*a* as a corrected driving waveform. As can be understood from this, the rank corresponding to the master ink and the rank corresponding to the use the user intends to use may be the same in some cases, and may be different in the other cases. This is because the correlations represented by formulas (1) and (2) are linear, and the linear lines have different inclinations and intercepts.

Figure 11:
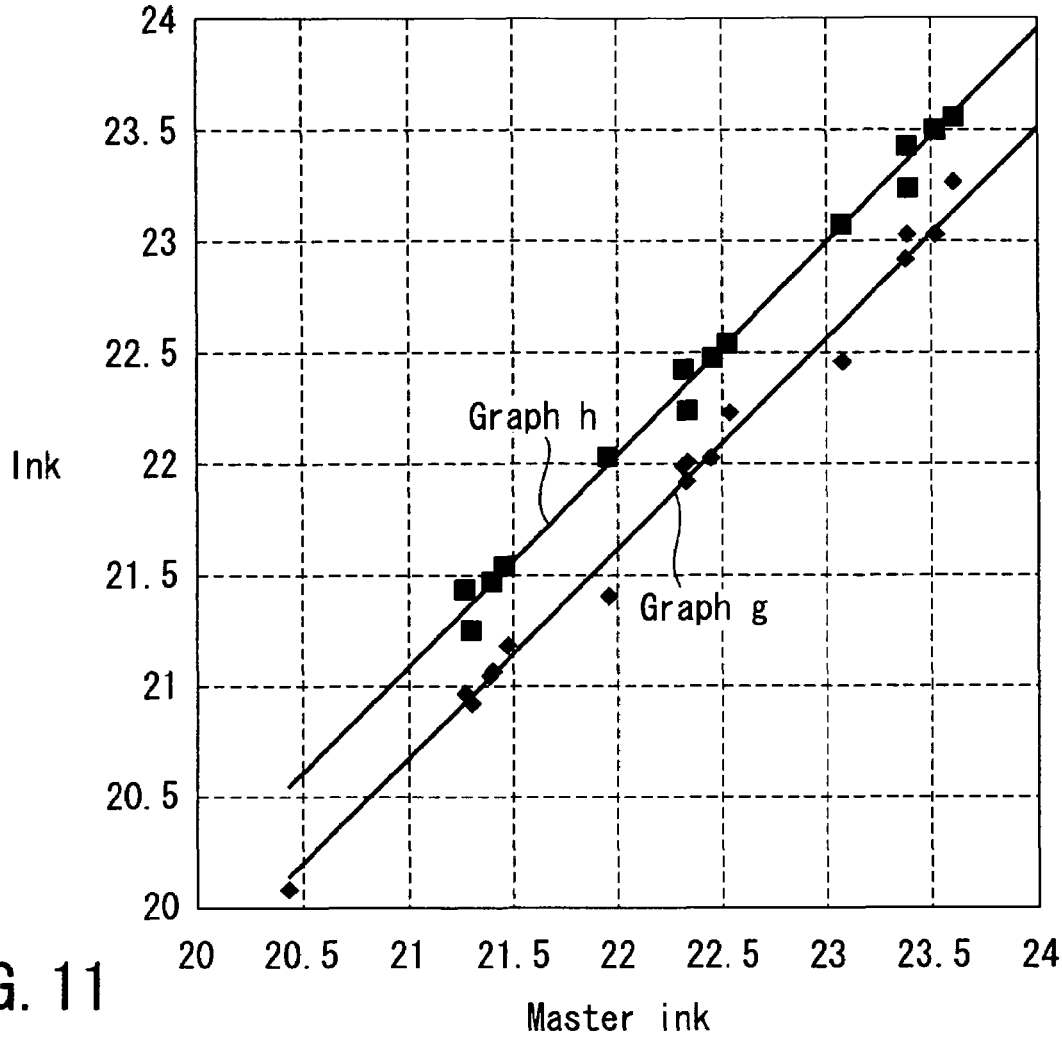
FIG. 11 is a graph showing correlations of driving voltages.

Then, with respect to the inkjet head 100, the driving voltages of the ink used by the user are calculated using correlation formulas. The correlation formulas for obtaining the driving voltages are: $Ov=\gamma 1\times Mv+\delta 1$ . . . (3) (Ov is a driving voltage when oil ink is used, Mv is a driving voltage when master ink is used, and $\gamma 1$ and $\delta 1$ are constants); and $Uv=\gamma 2\times Mv+\beta 2$ . . . (4) (Uv is a driving voltage when ultraviolet ink is used, Mv is a driving voltage when master ink is used, and $\gamma 2$ and $\delta 2$ are constants). As can be seen from FIG. 11, these formulas (3) and (4) are obtained beforehand on the basis of graph g showing the driving voltage correlations between the master ink and the oil ink and graph h showing the driving voltage correlations between the master ink and the ultraviolet ink. In FIG. 11, the abscissa represents the driving voltage corresponding to the case where the master ink is used, and the ordinate represents driving voltages corresponding to the case where the oil ink and the ultraviolet ink are used.

By way of example, let us assume that the ink the user intends to use for image recording is oil ink. In this case, the measurement of the voltage obtained when the master ink is used is substituted into formula (3), for correction. After this correction, the measurement is set for the driving voltage setting section 18*b*.

As described above, the driving waveform and driving voltage of the inkjet head 100 are measured and determined, using the master ink. The driving waveform and the driving voltage, thus obtained, are corrected on the basis of the correlation formulas, which are obtained beforehand for each type of ink. After this correction, the driving waveform and the driving voltage are set for the driving waveform setting section 18*a* and the driving voltage setting section 18*b*, respectively. In this manner, the driving waveform and the driving waveform of the inkjet head 100 need not be measured in accordance with the type of ink the user intends to use for image recording, and the printing test need not be performed in accordance therewith. Furthermore, the use of the correlation formulas obtained beforehand enables a driving waveform and a driving voltage to be efficiently set for the inkjet head 100 in accordance with the type of ink the user intends to use.

Since a plurality of setting ranks are determined with respect to the driving waveform, a desirable driving waveform can be set for the inkjet head 100 even if the driving waveform varies during the current supply time. Therefore, the number of inkjet heads that can only be used as top plates 11 in the prior art can be decreased. As a result, the manufacturing cost of the inkjet heads 100 can be lowered.

Figure 12:
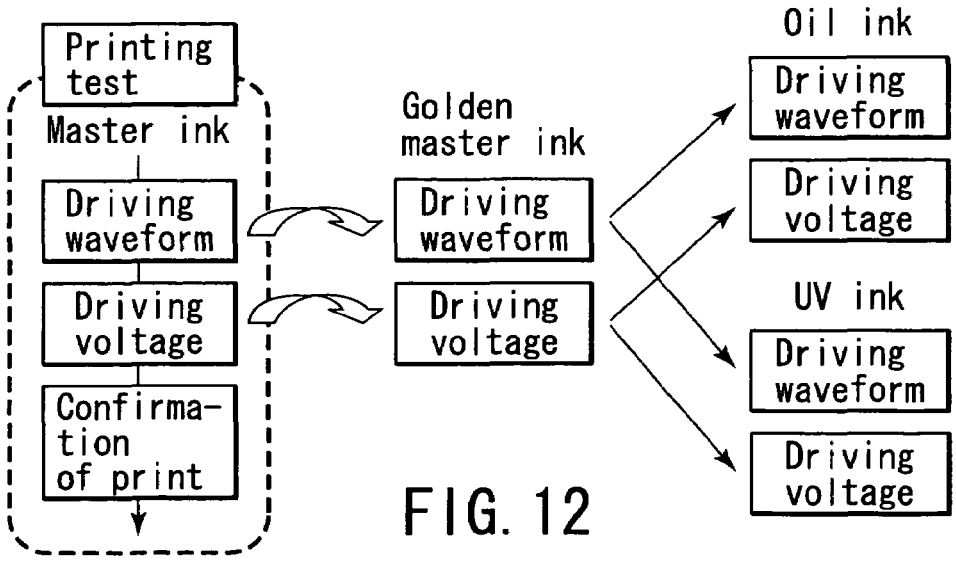
FIG. 12 is a diagram illustrating another method for setting the driving waveform and the driving voltage of an inkjet head.

As described above, it is very advantageous to determine a driving waveform and a driving waveform by use of the master ink. A method for further enhancing the accuracy will be described with reference to FIG. 12. FIG. 12 illustrates a method for setting a driving waveform and a driving voltage of an inkjet head when golden master ink, which is standard master ink, is used.

Master ink contains a dyeing agent, as described above, and it may exhibit different characteristics for different lots. If the master ink corresponding to one lot and the master ink corresponding to another exhibit different characteristics, the driving waveform and the driving voltage may slightly vary, depending upon the lots of the inkjet heads 100. Therefore, the measurements obtained by use of the master ink are corrected by use of the golden master ink, which uses the same solvent as the master ink but does not contain a dyeing agent. The golden master ink contains 70 wt. % of hydrocarbon-based oil and 30 wt. % of aliphatic alcohol, and no dyeing agent is contained. Using this as a master ink, measurements are corrected. To be more specific, the driving waveform and the driving voltage are measured using master ink, and correction values obtained beforehand are added to the measured driving voltage and the driving waveform, thereby obtaining the driving waveform and driving voltage corresponding to the case where the golden master ink is used. A rank is selected based on the driving waveform and driving voltage, and these driving waveform and driving voltage are converted into values that are suitable to the type of ink the user uses, on the basis of correlation formulas (1), (2), etc. In this manner, the characteristic variations are suppressed. Likewise, the driving voltage is measured using master ink, and a correction value obtained beforehand is added to the measured driving voltage. The driving voltage, thus obtained, is converted into a value that is suitable to the type of ink the user uses, on the basis of correlation formulas (3), (4), etc. In this manner, the characteristic variations are suppressed. Since the driving voltage, in particular, is an important factor for properly jetting a desired volume, variations in the driving voltage must be suppressed.

Where a plurality of inspection apparatuses are employed, the characteristic variations among them are suppressed based on the same technical concept as described above.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the invention defined by the appended claims and equivalents thereof.

What is claimed is:

1. An inkjet head inspecting method comprising:

filling an inkjet head with inspecting ink;

measuring a driving waveform shown by the inkjet head;

applying the measured driving waveform to one of a plurality of ranks determined based on a minimum resolution unit of the driving waveform; and performing a printing test based on a driving waveform corresponding to the rank to which the measured driving waveform is applied;

correcting the measured driving waveform based on a correlation formula, which is obtained beforehand based on image recording ink used by the inkjet head for image recording;

setting the inkjet head to have a driving waveform based on a result of the correction;

wherein the inspecting ink contains a dyeing agent.

2. An inkjet head inspecting method according to claim 1, further comprising adding a correction value to the measured waveform, wherein the correction value is obtained based on standard ink serving as a standard of the inspecting ink.

3. An inkjet head inspecting method according to claim 2, wherein the standard ink lacks the dyeing agent contained in the inspecting ink.

4. An inkjet head inspecting method according to claim 1, wherein the image recording ink comprises oil ink.

5. An inkjet head inspecting method according to claim 1, wherein the image recording ink comprises ultraviolet ink.

6. An inkjet head inspecting method comprising:

filling an inkjet head with inspecting ink;

measuring a driving voltage shown by the inkjet head;

adding a correction value to the measured voltage, wherein the correction value is obtained based on standard ink serving as a standard of the inspecting ink;

correcting the measured driving voltage based on a correlation formula, which is obtained beforehand based on image recording ink used by the inkjet head image recording;

setting the inkjet head to have a driving voltage based on a result of the correction; and performing a printing test based on the driving voltage set for the inkjet head, wherein the inspecting ink contains a dyeing agent.

7. An inkjet head inspecting method according to claim 6, wherein the standard ink lacks the dyeing agent contained in the inspecting ink.

8. An inkjet head inspecting method according to claim 6, wherein the image recording ink comprises oil ink.

9. An inkjet head inspecting method according to claim 6, wherein the image recording ink comprises ultraviolet ink.

* * * * *